US011086251B2

(12) United States Patent
Mase et al.

(10) Patent No.: US 11,086,251 B2
(45) Date of Patent: Aug. 10, 2021

(54) IMAGE FORMING APPARATUS INCLUDING CONTROL CIRCUITRY TO EXECUTE A WARM-UP OPERATION

(71) Applicants: Ryusuke Mase, Kanagawa (JP); Yoshihiro Fujiwara, Kanagawa (JP); Yuki Oshikawa, Kanagawa (JP); Naohiro Kawashima, Kanagawa (JP); Yuuki Tsuchiya, Tokyo (JP)

(72) Inventors: Ryusuke Mase, Kanagawa (JP); Yoshihiro Fujiwara, Kanagawa (JP); Yuki Oshikawa, Kanagawa (JP); Naohiro Kawashima, Kanagawa (JP); Yuuki Tsuchiya, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/579,882

(22) Filed: Sep. 24, 2019

(65) Prior Publication Data

US 2020/0117119 A1 Apr. 16, 2020

(30) Foreign Application Priority Data

Oct. 10, 2018 (JP) ..... JP2018-191463

(51) Int. Cl.
*G03G 15/08* (2006.01)

(52) U.S. Cl.
CPC ..... *G03G 15/0863* (2013.01); *G03G 15/0889* (2013.01)

(58) Field of Classification Search
None
See application file for complete search history.

(56) References Cited

U.S. PATENT DOCUMENTS 5,784,669 A * 7/1998 Miura ..... G03G 15/0856 399/58
6,256,469 B1 * 7/2001 Taniyama ..... G03G 15/0872 399/12
2009/0214233 A1 * 8/2009 Murauchi ..... G03G 15/0893 399/30
2010/0189455 A1 * 7/2010 Kim ..... G03G 15/0877 399/53
2017/0293257 A1 10/2017 Ohhira et al.
(Continued)

FOREIGN PATENT DOCUMENTS

JP 8-137230 5/1996
JP 2004-117387 4/2004
(Continued)

*Primary Examiner* — Victor Verbitsky
(74) *Attorney, Agent, or Firm* — Xsensus LLP

(57) ABSTRACT

An image forming apparatus includes a developing device including at least one stirring rotator configured to stir a developer in the developing device, a driver configured to drive the at least one stirring rotator in forward and reverse rotation, a device detector configured to detect whether the developing device is set in the image forming apparatus, and control circuitry configured to execute a warm-up operation. In the warm-up operation, the driver drives the at least one stirring rotator alternately in the reverse rotation and the forward rotation in response to a detection of setting of the developing device in the image forming apparatus by the device detector and a detection of a predetermined condition.

8 Claims, 6 Drawing Sheets

(56) References Cited

U.S. PATENT DOCUMENTS

| | | | |
|---|---|---|---|
| 2017/0351195 | A1 | 12/2017 | Koshizuka et al. |
| 2018/0136586 | A1 | 5/2018 | Tsuchiya et al. |
| 2018/0143568 | A1 | 5/2018 | Ohhira et al. |
| 2019/0018343 | A1 | 1/2019 | Oshikawa |

FOREIGN PATENT DOCUMENTS

| | | |
|---|---|---|
| JP | 2006-162895 | 6/2006 |
| JP | 2010-152098 | 7/2010 |
| JP | 2013-205475 | 10/2013 |
| JP | 2013-218300 | 10/2013 |

* cited by examiner

IMAGE FORMING APPARATUS INCLUDING CONTROL CIRCUITRY TO EXECUTE A WARM-UP OPERATION

CROSS-REFERENCE TO RELATED APPLICATION

This patent application is based on and claims priority pursuant to 35 U.S.C. § 119(a) to Japanese Patent Application No. 2018-191463, filed on Oct. 10, 2018, in the Japan Patent Office, the entire disclosure of which is hereby incorporated by reference herein.

BACKGROUND

Technical Field

Embodiments of the present disclosure generally relate to an image forming apparatus such as a copier, a printer, a facsimile machine, or a multifunction peripheral (MFP) having at least two of such capabilities.

Description of the Related Art

There are image forming apparatuses, such as copiers, printers, and the like, in which a developing device is removably installed. The developing device includes a stirring rotator to stir a developer contained therein.

SUMMARY

Embodiments of the present disclosure describe an improved image forming apparatus that includes a developing device including at least one stirring rotator configured to stir a developer in the developing device, a driver configured to drive the at least one stirring rotator in forward and reverse rotation, a device detector configured to detect whether the developing device is set in the image forming apparatus, and control circuitry configured to execute a warm-up operation. In the warm-up operation, the driver drives the at least one stirring rotator alternately in the reverse rotation and the forward rotation in response to a detection of setting of the developing device in the image forming apparatus by the device detector and a detection of a predetermined condition.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
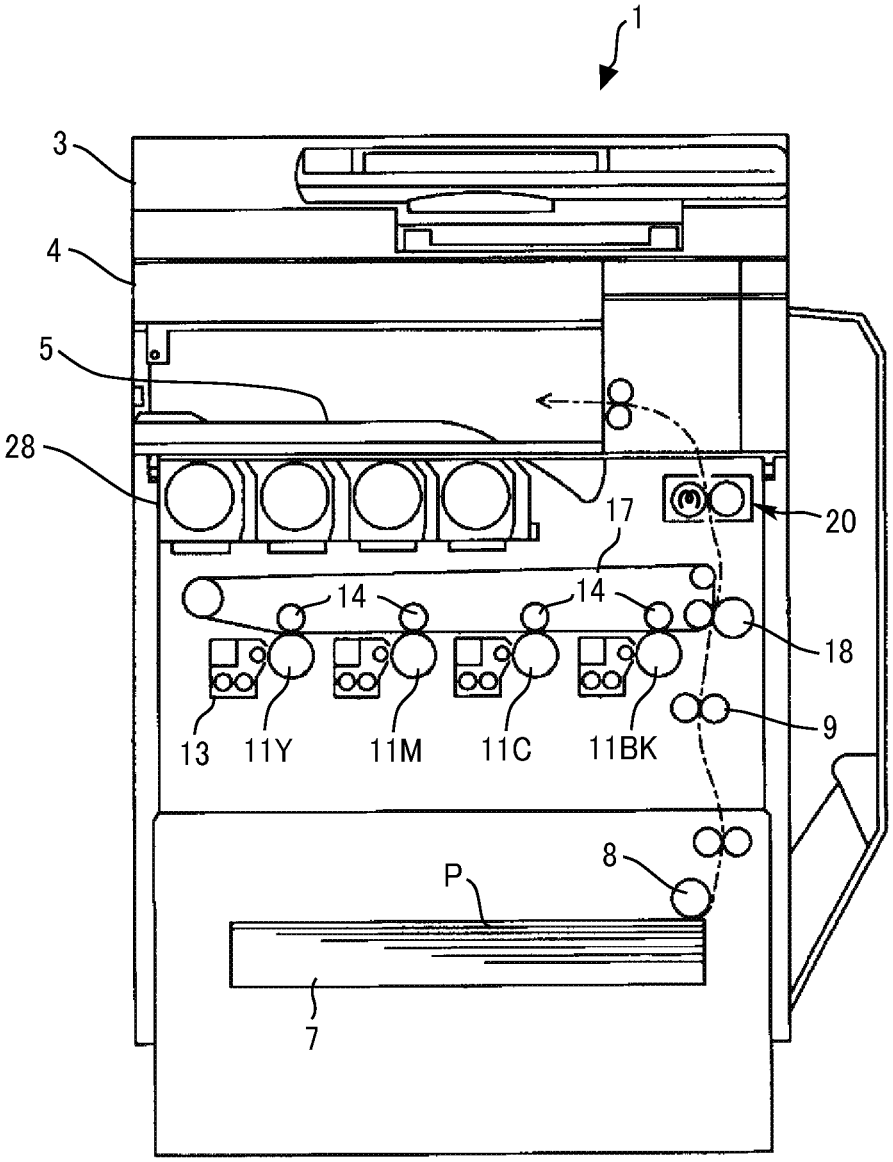
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. It is to be understood that identical or similar reference numerals are assigned to identical or corresponding components throughout the drawings, and redundant descriptions are omitted or simplified below as required.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black toner images, respectively, and hereinafter may be omitted when color discrimination is not necessary.

With reference to FIG. 1, a configuration and operation of an image forming apparatus 1 is described below.

In FIG. 1, the image forming apparatus 1, which is a tandem color copier in the present embodiment, includes a document conveyance device 3, a document scanner 4, an output tray 5, a sheet feeding device 7, and a registration roller pair (a timing roller pair) 9. The document conveyance device 3 conveys a document to the document scanner 4. The document scanner 4 reads document image data. The output tray 5 stacks output images. The sheet feeding device 7 contains sheets P such as paper sheets. The registration roller pair 9 adjusts the timing of conveyance of the sheet P.

The image forming apparatus 1 also includes photoconductor drums 11Y, 11M, 11C, and 11BK as image bearers, developing devices 13, primary transfer rollers 14, and an intermediate transfer belt 17. Electrostatic latent images are formed on surfaces of the photoconductor drums 11Y, 11M, 11C, and 11BK and developed into toner images of yellow, magenta, cyan, and black by the developing devices 13. The toner images on the surfaces of the photoconductor drums 11Y, 11M, 11C, and 11BK are transferred to and superimposed on the intermediate transfer belt 17 by the primary transfer rollers 14, thereby forming a multicolor toner image on the intermediate transfer belt 17.

The image forming apparatus 1 further includes a secondary transfer roller 18, a fixing device 20, and toner containers 28. The secondary transfer roller 18 transfers the multicolor toner image on the intermediate transfer belt 17 onto the sheet P. The fixing device 20 fixes the multicolor toner image (unfixed image) on the sheet P. The toner containers 28 contain yellow, magenta, cyan, and black toners to supply the toners to the developing devices 13.

A description is provided below of operation of the image forming apparatus 1 when forming a normal color image.

Figure 2:
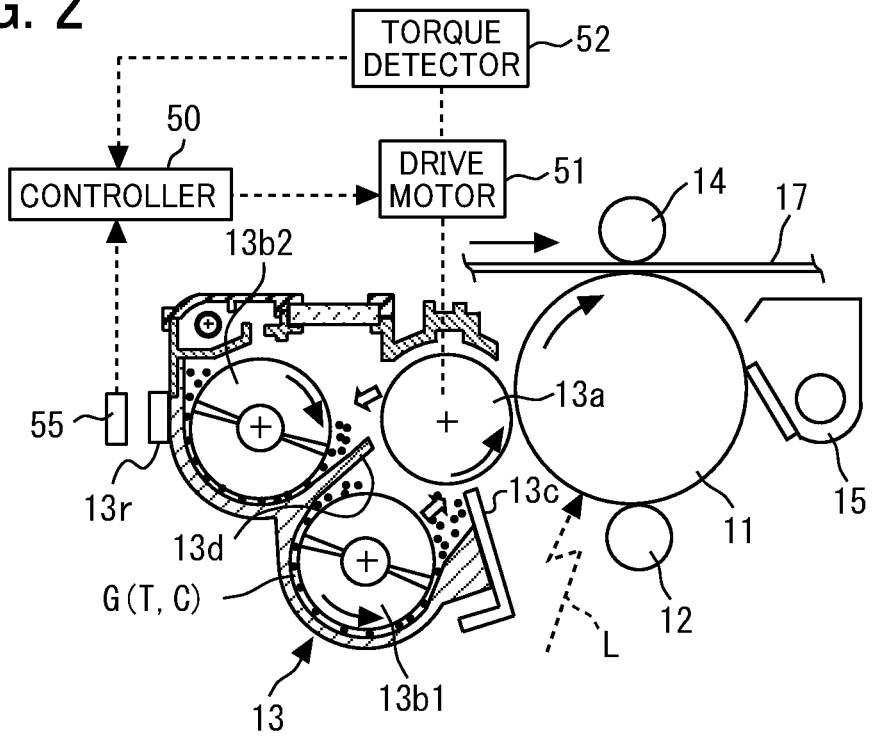
FIG. 2 is a schematic view illustrating a configuration of an image forming unit included in the image forming apparatus illustrated in FIG. 1.

It is to be noted that FIG. 2 is also referred to when image forming process performed on the respective photoconductor drums 11Y, 11M, 11C, and 11BK (hereinafter, also collectively referred to as "photoconductor drums 11") is described. FIG. 2 is a schematic view illustrating a configuration of the image forming unit.

A conveyance roller of the document conveyance device 3 conveys a document on a document table onto an exposure glass of the document scanner 4. Then, the document scanner 4 optically scans document image data.

More specifically, the document scanner 4 scans an image of the document on the exposure glass with light emitted from an exposure device. The light reflected from the surface of the document is directed onto a color sensor via mirrors and lenses to form multicolor image data of the scanned document. The multicolor document image data, which is decomposed into red, green, and blue (RGB) image data, is read by the color sensor and converted into electrical image signals. An image processor performs image processing (e.g., color conversion, color calibration, and spatial frequency adjustment) according to the image signals of the decomposed RGB image data, and thus image data for yellow, magenta, cyan, and black toner images are obtained.

The image data for yellow, magenta, cyan, and black toner images are sent to a writing device. The writing device directs a laser beam L (see FIG. 2) onto a surface of the corresponding photoconductor drum 11 according to image data for each color.

Meanwhile, the four photoconductor drums 11 rotate clockwise as illustrated in FIGS. 1 and 2. Initially, the surface of each photoconductor drum 11 is uniformly charged by a charging device 12 (see FIG. 2) at a position opposite the charging device 12 (a charging process). Thus, the surface of the photoconductor drum 11 is charged to a certain potential. Subsequently, the charged surface of the photoconductor drum 11 reaches a position where the surface is scanned by the laser beam L.

The writing device emits the laser beam L from each of four light sources according to the image data. The respective laser beams L travel different optical paths for the different components of yellow, magenta, cyan, and black (an exposure process).

The laser beam L corresponding to the yellow component is directed onto the surface of the photoconductor drum 11Y that is the first from the left in FIG. 1 among the four photoconductor drums 11Y, 11M, 11C, and 11K. A polygon mirror that rotates at high velocity deflects the laser beam L for yellow along the axis of rotation of the photoconductor drum 11 (i.e., the main-scanning direction) so that the laser beam L scans the surface of the photoconductor drum 11. Thus, an electrostatic latent image for yellow is formed on the surface of the photoconductor drum 11 charged by the charging device 12.

Similarly, the laser beam L corresponding to the magenta component is directed onto the surface of the photoconductor drum 11M that is the second from the left in FIG. 1, thus forming an electrostatic latent image for magenta thereon. The laser beam L corresponding to the cyan component is directed onto the surface of the photoconductor drum 11C that is the third from the left in FIG. 1, thus forming an electrostatic latent image for cyan thereon. The laser beam L corresponding to the black component is directed onto the surface of the photoconductor drum 11BK that is the fourth from the left in FIG. 1, thus forming an electrostatic latent image for black thereon.

Then, the surface of the photoconductor drum 11 having the electrostatic latent image reaches a position opposite the developing device 13. The developing device 13 supplies toner of each color to the photoconductor drum 11 and develops the electrostatic latent image on the photoconductor drum 11 into a visible toner image (a development process).

Subsequently, the surfaces of the photoconductor drums 11 reach positions facing the intermediate transfer belt 17. The primary transfer rollers 14 are disposed at positions where the photoconductor drums 11 face the intermediate transfer belt 17 and in contact with an inner surface of the intermediate transfer belt 17, respectively. At the positions of the primary transfer rollers 14, the toner images on the photoconductor drums 11Y, 11M, 11C, and 11BK are transferred to and superimposed on the intermediate transfer belt 17, forming a multicolor toner image thereon (a primary transfer process).

After the primary transfer process, the surface of the photoconductor drum 11 reaches a position opposite a cleaning device 15. The cleaning device 15 collects untransferred toner remaining on the photoconductor drum 11 (a cleaning process).

Then, the surface of the photoconductor drum 11 passes through the discharger to complete a series of image forming processes performed on the photoconductor drum 11.

The multicolor toner image is formed on a surface of the intermediate transfer belt 17 by transferring and superimposing the respective single-color toner images formed on the photoconductor drums 11. Then, the intermediate transfer belt 17 carrying the multicolor toner image moves counterclockwise in FIG. 1 to reach a position opposite the secondary transfer roller 18 (i.e., a secondary transfer nip). The secondary transfer roller 18 secondarily transfers the multicolor toner image carried on the intermediate transfer belt 17 onto the sheet P (a secondary transfer process).

After the secondary transfer process, the surface of the intermediate transfer belt 17 reaches a position opposite a belt cleaning device. The belt cleaning device collects untransferred toner adhering to the intermediate transfer belt 17 to complete a sequence of transfer processes performed on the intermediate transfer belt 17.

The sheet P is conveyed from the sheet feeding device 7 via the registration roller pair 9 to the secondary transfer nip between the intermediate transfer belt 17 and the secondary transfer roller 18.

More specifically, a sheet feeding roller 8 feeds the sheet P from the sheet feeding device 7 that contains multiple sheets P, and the sheet P is then guided by a sheet guide to the registration roller pair 9. The sheet P that has reached the registration roller pair 9 is conveyed toward the secondary transfer nip, timed to coincide with the arrival of the multicolor toner image on the intermediate transfer belt 17.

Then, the sheet P carrying the multicolor toner image is conveyed to the fixing device 20. The fixing device 20 includes a fixing roller and a pressure roller pressing against each other. In a nip between the fixing roller and the pressure roller, the multicolor toner image is fixed on the sheet P.

After the fixing process, an output roller pair ejects the sheet P as an output image outside the image forming apparatus 1, and the ejected sheet P is stacked on the output tray 5. Thus, a series of the image forming processes is completed.

Next, an image forming unit of the image forming apparatus 1 is described in further detail below with reference to FIGS. 2 to 4.

Figure 3:
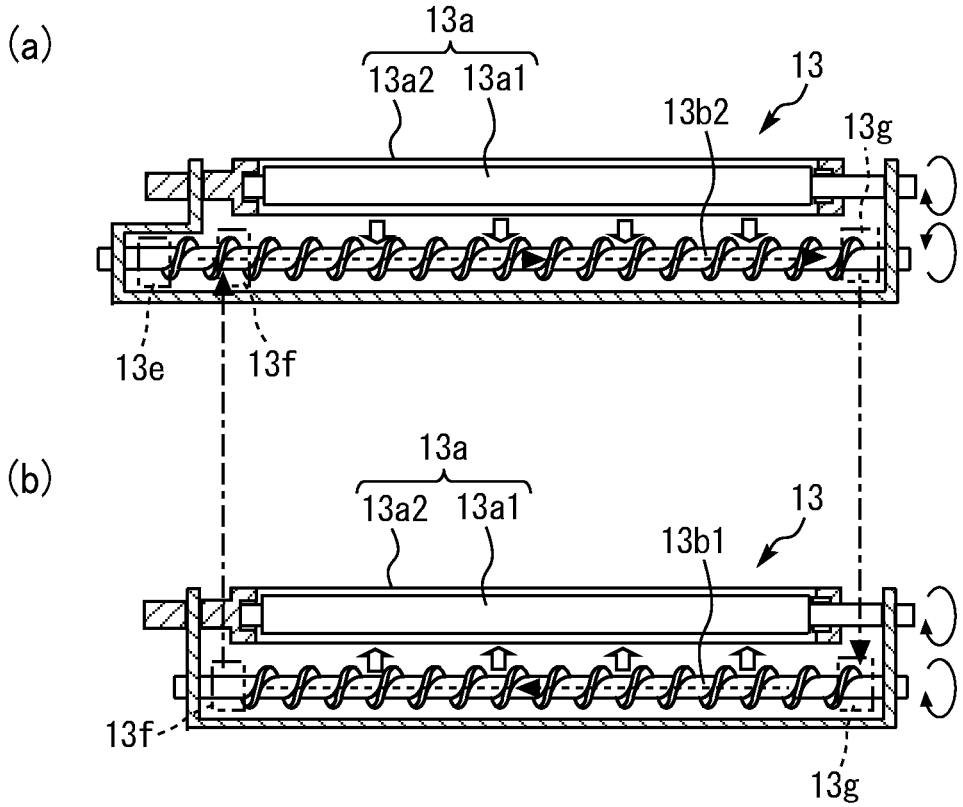
FIG. 3 is a schematic cross-sectional view of a developing device of the image forming unit in FIG. 2 along a longitudinal direction of the developing device.
Figure 4A:
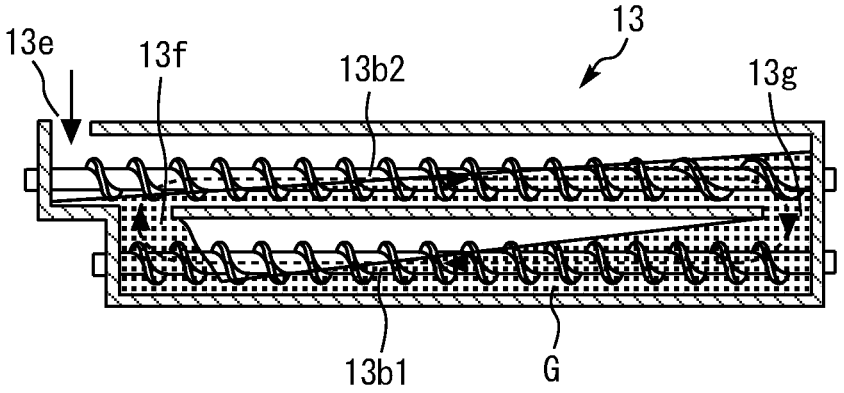
FIGS. 4A and 4B are schematic cross-sectional views illustrating a circulation path of the developing device in FIG. 3 along the longitudinal direction of the developing device.
Figure 4B:
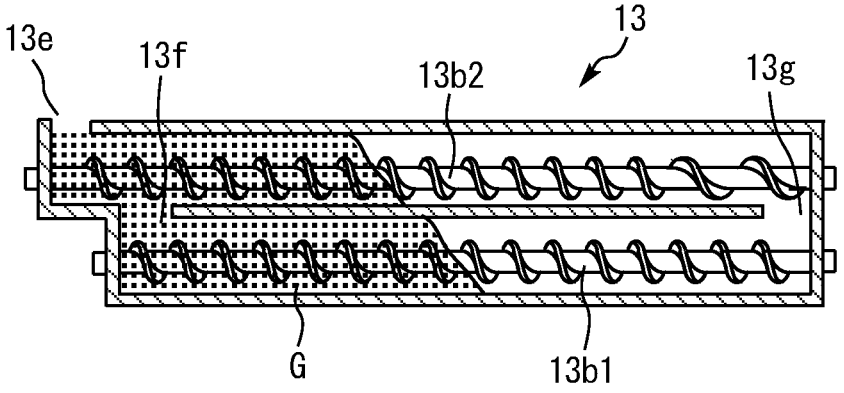

FIG. 3 is a horizontal schematic cross-sectional view of the developing device 13 along the longitudinal direction of the developing device 13. FIG. 3 illustrates a circulation path of a developer in the developing device 13. In a part (a) of FIG. 3, a second stirring screw 13*b*2 for collecting the developer is disposed in a collection path of an upper portion of the developing device 13. In a part (b) of FIG. 3, a first stirring screw 13*b*1 for supplying the developer is disposed in a supply path of a lower portion of the developing device 13. FIGS. 4A and 4B are vertical schematic cross-sectional views illustrating the circulation path of the developer in the developing device 13 along the longitudinal direction of the developing device 13.

It is to be noted that the suffixes Y, M, C, and BK of the photoconductor drum 11, the developing device 13, and the like are omitted in FIGS. 2 to 4 and the like for simplicity because the image forming units have a similar configuration.

With continued reference to FIG. 2, as illustrated in FIG. 2, each image forming unit includes the photoconductor drum 11 as the image bearer, the charging device 12, the developing device 13, the cleaning device 15, and the like.

The photoconductor drum 11 as the image bearer in the present embodiment is a negatively-charged organic photoconductor and is rotated clockwise in FIG. 2 by a drive motor.

The charging device 12 is an elastic charging roller and can be formed by coating a core with an elastic layer of moderate resistivity, such as foamed urethane, that includes carbon black as conductive particles, a sulfuration agent, a foaming agent, and the like. The material of the elastic layer of moderate resistivity of the charging device 12 includes, but is not limited to, rubber such as urethane, ethylene-propylene-diene-polyethylene (EPDM), acrylonitrile butadiene rubber (NBR), silicone rubber, and isoprene rubber to which a conductive material such as carbon black or metal oxide is added to adjust the resistivity. Alternatively, foamed rubber including these materials may be used.

The cleaning device 15 includes a cleaning blade that slides over the surface of the photoconductor drum 11 and mechanically removes untransferred toner on the photoconductor drum 11.

The developing device 13 includes a developing roller 13*a*, serving as a developer bearer, opposed to the photoconductor drum 11 via a slight gap, and a development range (a development nip) where a magnetic brush formed on the developing roller 13*a* contacts the photoconductor drum 11 is formed in a portion where the developing roller 13*a* is opposed to the photoconductor drum 11. The developing device 13 contains a two-component developer G including toner T and carrier C. The developing device 13 develops the electrostatic latent image on the photoconductor drum 11 into a toner image. A detailed description of the configuration and operation of the developing device 13 is deferred.

With reference to FIG. 1, the toner containers 28 contain the toner T to be supplied to the developing devices 13. Specifically, the developing device 13 includes a magnetic sensor to detect toner concentration (i.e., a ratio of toner T to the developer G). According to the toner concentration detected by the magnetic sensor, the toner T is supplied from the toner container 28 to the developing device 13 via a toner conveyance tube and a toner supply inlet 13*e* (see FIGS. 3 and 4A).

In the present embodiment, any toner can be used as the toner T in the developer G and the toner T in the toner container 28, and any carrier can be used as the carrier C in the developer G.

The developing device 13 of the image forming apparatus 1 is described in further detail below.

As illustrated in FIGS. 2 to 4, the developing device 13 includes the developing roller 13*a* serving as the developer bearer, the first and second stirring screws (conveyance screws) 13*b*1 and 13*b*2 serving as stirring rotators, and a doctor blade 13*c* serving as a developer regulator.

The developing roller 13*a* includes a cylindrical sleeve 13*a*2 made of a nonmagnetic material and rotates counterclockwise in FIG. 2 by a drive motor 51 as a driver. The nonmagnetic material includes, but is not limited to, aluminum, stainless steel, brass, and conductive resin. With reference to FIG. 3, a magnet 13*a*1 is secured inside the sleeve 13*a*2 of the developing roller 13*a* and generates multiple magnetic poles around a circumferential surface of the sleeve 13*a*2. The developer G carried on the developing roller 13*a* is transported to the doctor blade 13*c* along with rotation of the developing roller 13*a* in the counterclockwise direction indicated by the arrow in FIG. 2. An amount of developer G on the developing roller 13*a* is adjusted by the doctor blade 13*c*, after which the developer G is transported to the development range opposite the photoconductor drum 11. Then, the toner in the developer G is attracted onto the latent image formed on the photoconductor drum 11 due to the effect of an electric field for development generated in the development range.

Specifically, a scooping pole of the multiple magnetic poles acts on magnetic carrier C in the developer G, and thus the developer G contained in the supply path of the developing device 13 is partially scooped up on the developing roller 13*a*. A part of the developer G carried on the developing roller 13*a* is scraped off by the doctor blade 13*c* and returned to the supply path. The developer G passes through a doctor gap between the doctor blade 13*c* and the developing roller 13*a* where the scooping pole acts. Then, the grains of the developer G carried on the developing roller 13*a* stand on end on the developing roller 13*a* due to the magnetic force exerted by a main pole of the multiple magnetic poles, forming a magnetic brush in the development range and slidingly contact the photoconductor drum 11. Thus, the toner T in the developer G carried on the developing roller 13*a* adheres to the latent image formed on the photoconductor drum 11. After passing through the development range where the main pole acts, the developer G passes between an upper cover and the developing roller 13*a* by the magnetic force exerted by a conveyance pole of the multiple magnetic poles and is transported to a position corresponding to a developer release pole of the multiple magnetic poles. Then, at the position corresponding to the developer release pole, magnetic repulsion to separate the developer G from the developing roller 13*a* acts on the carrier C, and the developer G carried on the developing roller 13*a* after the development process is removed from the developing roller 13*a*. Then, the developer G drops into the collection path of the developing device 13 and is transported downstream by the second stirring screw 13*b*2 therein.

With reference to FIG. 2, the doctor blade 13*c* as the developer regulator is a nonmagnetic plate disposed below the developing roller 13*a*. Alternatively, a portion of the doctor blade 13*c* can be made of a magnetic material. The doctor blade 13*c* is opposed to the developing roller 13*a* below the developing roller 13*a*, serving as the developer regulator to adjust the amount of the developer G carried on the developing roller 13*a*.

In FIG. 2, the developing roller 13*a* rotates counterclockwise, and the photoconductor drum 11 rotates clockwise.

The first and second stirring screws 13*b*1 and 13*b*2 stir the developer G contained in the developing device 13 while circulating the developer G in the longitudinal direction of the developing device (hereinafter also referred to as "developer conveyance direction"), perpendicular to the surface of the paper on which FIG. 2 is drawn.

The first stirring screw 13*b*1 as the stirring rotator for supplying the developer is opposed to the developing roller 13*a* and supplies the developer G to the developing roller 13*a* as indicated by white arrows illustrated in the part (b) of FIG. 3 at the position corresponding to the scooping pole while horizontally transporting the developer G in the developer conveyance direction to the left in the FIG. 3 as indicated by a broken arrow illustrated in the part (b) of FIG. 3. The first stirring screw 13*b*1 rotates counterclockwise in FIG. 2.

The second stirring screw 13*b*2 as the stirring rotator for collecting the developer is disposed above the first stirring screw 13*b*1 and opposed to the developing roller 13*a*. The second stirring screw 13*b*2 horizontally transports the developer G that has been forcibly separated from the developing roller 13*a* by the developer release pole in the direction indicated by white arrows in the part (a) of FIG. 3 to the right in FIG. 3 as indicated by a broken arrow illustrated in the part (a) of FIG. 3. In the present embodiment, the second stirring screw 13*b*2 rotates in the direction opposite to the developing roller 13*a* (i.e., clockwise in FIG. 2).

The developer G is transported from the downstream side of the supply path (hereinafter, also referred to as "a first transport path") in which the first stirring screw 13*b*1 is disposed, through a first communication opening 13*f*, and to the collection path (hereinafter, also referred to as "a second transport path") in which the second stirring screw 13*b*2 is disposed. The second stirring screw 13*b*2 transports the developer G downstream in the collection path (the second transport path) and to the upstream side of the supply path (the first transport path) through a second communication opening 13*g* (as indicated by alternate long and short dashed arrow in FIG. 3).

The first and second stirring screws 13*b*1 and 13*b*2 are disposed so that axes of rotation of the first and second stirring screws 13*b*1 and 13*b*2 are substantially horizontal similar to the developing roller 13*a* and the photoconductor drum 11. Each of the first and second stirring screws 13*b*1 and 13*b*2 includes a screw shaft and a helical blade winding around the screw shaft.

A controller 50 controls the drive motor 51 to rotate the first and second stirring screws 13*b*1 and 13*b*2 along with the developing roller 13*a*. That is, the first and second stirring screws 13*b*1 and 13*b*2 and the developing roller 13*a* constitute a drive system with a gear train and are driven to rotate by the drive motor 51 as the driver.

Specifically, a coupling to which driving force is directly transmitted from the drive motor 51 is disposed on a shaft on one end of the developing roller 13*a* in the longitudinal direction of the developing roller 13*a* (i.e., the direction perpendicular to the paper on which FIG. 2 is drawn and the left and right direction in FIG. 3). Further, a gear is disposed on the shaft on the one end of the developing roller 13*a* in the longitudinal direction, and the gear meshes with a gear disposed on a shaft on one end of the first stirring screw 13*b*1 in the longitudinal direction via an idler. In addition, a first gear is disposed on the shaft on the other end of the first stirring screw 13*b* in the longitudinal direction and meshes with a second gear disposed on the shaft on the other end of the second stirring screw 13*b*2 in the longitudinal direction.

In the present embodiment, the drive motor 51 as the driver to drive the developing device 13 is provided independently of the drive motor to rotate the photoconductor drum 11. The drive motor 51 is a motor of forward and reverse bi-directional rotation type, and is configured to drive the developing device 13 in reverse, which is described in detail later.

An inner wall (a partition) 13*d* of the developing device 13 separates the first transport path (the supply path) in which the first stirring screw 13*b*1 is disposed and the second transport path (the collection path) in which the second stirring screw 13*b*2 is disposed.

With reference to FIGS. 3 and 4A, the downstream side of the second transport path (the collection path), in which the second stirring screw 13*b*2 is disposed, communicates with the upstream side of the first transport path (the supply path), in which the first stirring screw 13*b*1 is disposed, via the second communication opening 13*g*. In the downstream end portion of the second transport path, the developer G falls through the second communication opening 13*g* to the upstream end portion of the first transport path.

With reference to FIGS. 3 and 4A, the downstream side of the first transport path, in which the first stirring screw 13*b*1 is disposed, communicates with the upstream side of the second transport path, in which the second stirring screw 13*b*2 is disposed, via the first communication opening 13*f*. In the first transport path, the developer G that is not supplied to the developing roller 13*a* accumulates adjacent to the first communication opening 13*f* and then is transported or supplied via the first communication opening 13*f* to the upstream end portion of the second transport path.

It is to be noted that a paddle or a screw winding in the direction opposite to the helical blade of the first stirring screw 13*b*1 may be provided on a downstream portion of the first stirring screw 13*b*1 to facilitate conveyance of the developer G at a position corresponding to the first communication opening 13*f*, which is conveyance from the supply path to the collection path against the direction of gravity.

This configuration provides the circulation path through which the developer G is circulated in the longitudinal direction by the first and second stirring screws (the stirring rotators) 13*b*1 and 13*b*2 in the developing device 13. That is, when the developing device 13 operates, the developer G contained therein flows in the developer conveyance direction indicated by the broken arrows illustrated in FIGS. 3, and 4A. Separating the first transport path (the supply path), in which the first stirring screw 13*b*1 supplies the developer (i to the developing roller 13*a*, from the second transport path (the collection path), to which the developer G is collected from the developing roller 13*a* by the second stirring screw 13*b*2, can reduce density unevenness of toner images formed on the photoconductor drum 11.

The magnetic sensor to detect the toner concentration in the developer G circulated in the developing device 13 is disposed in the collection path (the second transport path). Based on the toner concentration detected by the magnetic sensor, the fresh toner T is supplied from the toner container 28 to the developing device 13 through the toner supply inlet 13*e* disposed near the first communication opening 13*f*.

Additionally, with reference to FIGS. 3 and 4A, the toner supply inlet 13*e* is disposed above an upstream side portion of the second transport path, in which the second stirring screw 13*b*2 is disposed, away from the development range, that is, disposed outside the area occupied by the developing roller 13*a* in the longitudinal direction. Since the toner supply inlet 13*e* is disposed near of the first communication opening 13*f*, the developer G separated from the developing roller 13*a* falls on the supplied toner T, which has a small specific gravity, in the collection path, and the supplied toner T is sufficiently dispersed in and mixed with the developer G over a relatively extended period of time toward the downstream side of the collection path.

It is to be noted that the position of the toner supply inlet 13*e* is not limited to inside the collection path (the second transport path) but can be disposed above an upstream portion of the supply path, for example.

The configuration and operation of the image forming apparatus 1 according to the present embodiment are described in further detail below.

As described above with reference to FIGS. 1 to 3, the image forming apparatus 1 includes the developing device 13, the drive motor 51 as the driver.

The replaceable developing device 13 is removably installed in the image forming apparatus 1 and replaced with a new one (which may be a recycled product) in a predetermined replacement cycle. When the developing device 13 is installed (or set) in the image forming apparatus 1, the drive motor (the driver) 51 can transmit the driving force to the developing device 13. When the developing device 13 is removed from the image forming apparatus 1, the drive motor (the driver) 51 does not transmit the driving force to the developing device 13.

As described above, the developing device 13 includes the first and second stirring screws (conveyance screws) 13*b*1 and 13*b*2 as the stirring rotators to stir the developer G therein and the developing roller 13*a* opposed to the photoconductor drum (the image bearer) 11.

The drive motor (the driver) 51 rotates the developing roller 13*a* along with the first and second stirring screws (the stirring rotators) 13*b*1 and 13*b*2.

Here, the drive motor 51 as the driver drives the first and second stirring screws 13*b*1 and 13*b*2 as the stirring rotators in forward and reverse rotation. Specifically, the drive motor (the driver) 51 in the present embodiment is the forward and reverse bi-directional motor, and the controller 50 causes the drive motor 51 to rotate the first and second stirring screws 13*b*1 and 13*b*2 along with the developing roller 13*a* forward as described in FIGS. 2 and 5B or in reverse as described in FIG. 5A.

Figure 5A:
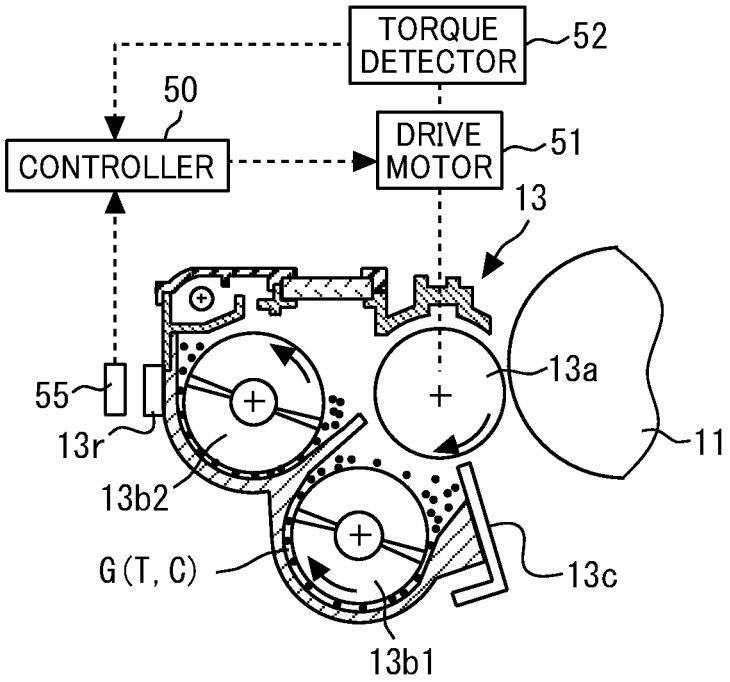
FIG. 5A is a schematic cross-sectional view of the developing device in a state in which a stirring screw is rotated in reverse in a warm-up operation.

As illustrated in FIGS. 2 and 5A, the image forming apparatus 1 further includes a reader/writer 55 to read and write data. The reader/writer 55 as a device detector detects whether the developing device 13 is set in the image forming apparatus 1.

Specifically, the developing device 13 includes a radiofrequency identification (RFID) tag 13*r* as a data storage medium. A reader/writer 55 is secured to the image forming apparatus 1 at a position opposite the RFID tag 13*r* of the developing device 13 set in the image forming apparatus 1. The RFID tag 13*r* stores data such as manufacturing date, manufacturing lot, usage history, operation time, recycling history, and the like, regarding the developing device 13, and such data are read and written by the reader/writer 55 as appropriate and used for various controls.

In particular, in the present embodiment, the controller 50 determines whether the developing device 13 is set in the image forming apparatus 1 depending on whether the reader/writer 55 detects the signal of the RFID tag 13*r*.

Further, in the present embodiment, when the developing device 13 has been used in any of the image forming apparatuses, the reader/writer 55 writes data regarding the usage history in the RFID tag 13*r*. Therefore, the controller 50 determines whether the developing device 13 set in the image forming apparatus 1 is new (including recycled) or not by the reader/writer 55. That is, the reader/writer 55 as the device detector can detect the state in which an unused developing device 13 is set in the image forming apparatus 1 for the first time.

In the present embodiment, when the reader/writer (the device detector) 55 detects that the developing device 13 being in a predetermined condition is set in the image forming apparatus 1, the controller 50 as control circuitry executes the warm-up operation (warming up mode) in which the drive motor (the driver) 51 drives the first and second stirring screws (stirring rotators) 13*b*1 and 13*b*2 alternately in the reverse rotation and the forward rotation.

Specifically, in the present embodiment, the warm-up operation is performed when the reader/writer (the device detector) 55 detects that the unused developing device 13 is set in the image forming apparatus 1 for the first time. That is, when the reader/writer 55 detects that a new developing device 13, which has not been used in any image forming apparatus, is first set in the image forming apparatus 1, the drive motor 51 repeatedly rotates in reverse and forward, and the developing device 13 (the developing roller 13*a*, the first stirring screw 13*b*1, and the second stirring screw 13*b*2) is driven in the reverse and forward directions before the image forming operation (the development process).

The reason for performing such "warm-up operation (warming up mode)" is to smooth the developer G leant to one side in the developing device 13 into a normal state before starting the image forming operation (image formation). As a result, the satisfactory image forming operation (the development process) can be performed.

However, as illustrated in FIG. 4B, when a new developing device 13, in which the developer G contained therein is leant to one side in the longitudinal direction of the developing device 13, is set as is in the image forming apparatus 1, if the drive motor 51 drives the first and second stirring screws 13*b*1 and 13*b*2 in the forward direction (forward rotation), starting torque of the drive motor 51 (mainly, the load for driving the first and second stirring screws 13*b* and 13*b*2) increases. When the starting torque of the drive motor 51 exceeds an upper limit to drive the developing device 13, the drive motor 51 locks up.

On the other hand, in the warm-up operation according to the present embodiment, the first and second stirring screws 13*b*1 and 13*b*2 is not driven in the forward rotation immediately after the new developing device 13 is set in the image forming apparatus 1. Since the reverse rotation and the forward rotation of the first and second stirring screws 13*b*1 and 13*b*2 are alternately repeated, an uneven distribution of the developer G in the developing device 13 can be eliminated without abruptly increasing the starting torque of the drive motor 51. That is, the developer G in the developing device 13 is leveled to a normal state without the lock of the drive motor 51. Specifically, when the first and second stirring screws 13*b*1 and 13*b*2 are rotated in reverse in the state illustrated in FIG. 4B, the developer G in the first transport path by the first stirring screw 13*b*1 is transported away from the first communication opening 13*f* where the developer G is accumulated, not in a direction to further accumulate the developer G near the first communication opening 13*f*. Therefore, the accumulation of the developer G near the first communication opening 13*f* is alleviated, and the uneven distribution of the developer G in the developing device 13 is eliminated without increasing the starting torque of the drive motor 51.

Note that, if only the reverse rotation of the first and second stirring screws 13*b*1 and 13*b*2 continues during the warm-up operation, the developer G is likely to overflow from the toner supply inlet 13*e*. Therefore, as in the present embodiment, the first and second stirring screws 13*b* and 13*b*2 are driven alternately in the reverse rotation and the forward rotation.

Figure 5B:
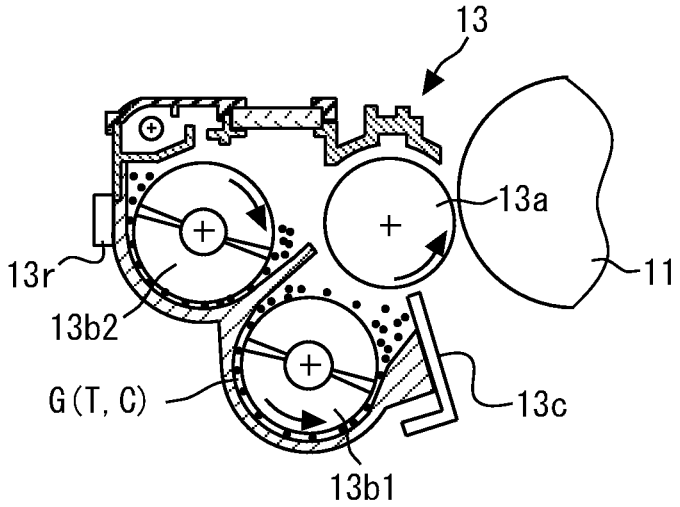
FIG. 5B is a schematic cross-sectional view of the developing device in a state in which the stirring screw is rotated forward in the warm-up operation.

Here, in the present embodiment, in the warm-up operation (warming up mode) described above, the first and second stirring screws (stirring rotators) 13*b*1 and 13*b*2 are driven alternately in the order of the reverse rotation and the forward rotation, not in the order of the forward rotation and the reverse rotation. That is, the developing device 13 set in the image forming apparatus 1 is first driven in the reverse rotation as illustrated in FIG. 5A, and then driven in the forward rotation as illustrated in FIG. 5B. Thereafter, the developing device 13 is repeatedly driven in such order (i.e., the order of the reverse rotation and the forward rotation).

Since the first and second stirring screws 13*b*1 and 13*b*2 are first driven in the reverse rotation, the lock of the drive motor 51 is less likely to occur as compared with the case in which the first and second stirring screws 13*b*1 and 13*b*2 are initially rotated forward. That is, as illustrated in FIG. 4B, if the first and second stirring screws 13*b*1 and 13*b*2 are rotated in the forward direction in the state in which the developer G is extremely leant to one side in the longitudinal direction of the developing device 13, the first forward rotation immediately after starting of the warm-up operation may lock the drive motor 51. On the other hand, such a drawback can be less likely to occur by the first reverse rotation immediately after starting of the warm-up operation.

Further, in the warm-up operation according to the present embodiment, the controller 50 can control so that the time T1 for driving the first and second stirring screws (stirring rotators) 13*b*1 and 13*b*2 in the reverse rotation is longer than the time T2 for driving in the forward rotation (i.e., T1>T2).

With this control, the developer G in the developing device 13 can be smoothed to the normal state in a short time as compared with the case in which the reverse rotation time T1 is set to the forward rotation time T2 or less.

Note that, when the reverse rotation time T1 is set longer than the forward rotation time T2, the reverse rotation time T1 is preferably set within a range in which the developer G does not overflow from the toner supply inlet 13*e*.

Figure 6:
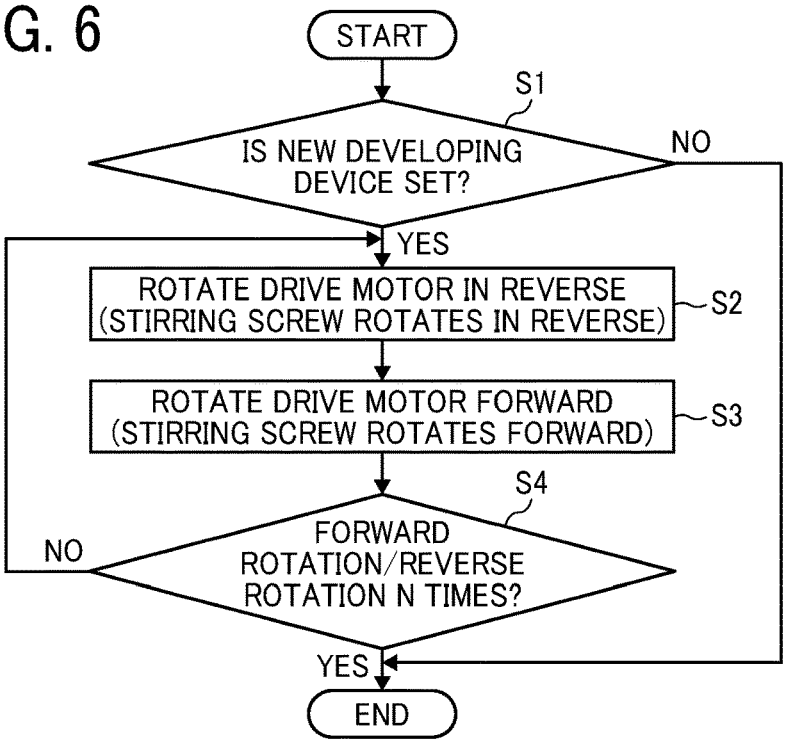
FIG. 6 is a flowchart of a control process executed when a new developing device is installed in the image forming apparatus.

FIG. 6 is a flowchart of a control process executed when a new developing device 13 is set in the image forming apparatus 1.

As illustrated in FIG. 6, first, the reader/writer 55 determines whether the new developing device 13 is set in the image forming apparatus 1 (step S1). As a result, when the reader/writer 55 determines that the new developing device 13 is not set in the image forming apparatus 1, the process is ended without performing the above-described warm-up operation. When the reader/writer 55 determines that the new developing device 13 is set in the image forming apparatus 1, the controller 50 performs the warm-up operation.

Specifically, first, the drive motor 51 rotates in reverse, and the first and second stirring screws 13*b*1 and 13*b*2 along with the developing roller 13*a* are driven in the reverse rotation for a predetermined time T1 (step S2). Subsequently, the drive motor 51 rotates forward, and the first and second stirring screws 13*b*1 and 13*b*2 along with the developing roller 13*a* are driven in the forward rotation for a predetermined time T2 (step S3). Then, such a reverse and forward rotation cycle is performed the predetermined number of times (N times) (step S4), and then the warm-up operation is ended.

Figure 7:
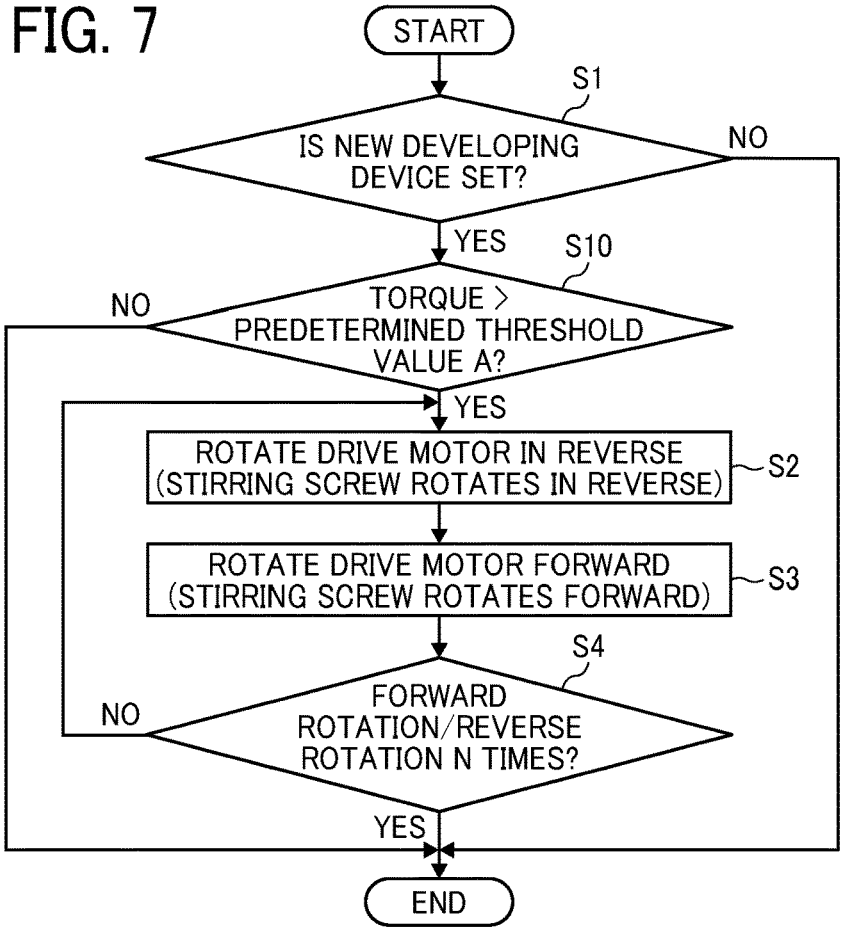
FIG. 7 is a flowchart of a control process executed when a new developing device is installed in the image forming apparatus according to a first variation.

FIG. 7 is a flowchart of a control process executed when a new developing device 13 is set in the image forming apparatus 1 according to a first variation, corresponding to FIG. 6 in the above-described embodiment.

As illustrated in FIGS. 2 and 5A, the image forming apparatus 1 according to the first variation includes a torque detector 52 configured to directly or indirectly detect torque applied when the first and second stirring screws (stirring rotators) 13*b*1 and 13*b*2 rotate. Specifically, in the first variation, the torque detector 52 indirectly detects the torque applied when the first and second stirring screws 13*b*1 and 13*b*2 rotate based on the change of the current flowing through the drive motor 51. More specifically, the torque detector 52 measures the torque such that the torque of the first and second stirring screws 13*b*1 and 13*b*2 is large when the current flowing through the drive motor 51 is large and that the torque of the first and second stirring screws 13*b*1 and 13*b*2 is small when the current flowing through the drive motor 5 is small.

In the first variation, when the reader/writer (the device detector) 55 detects that the developing device 13 is set in the image forming apparatus 1, if the torque detected by the torque detector 52 exceeds a predetermined threshold value A, the controller 50 performs the warm-up operation as in the present embodiment. For example, the predetermined threshold value A is stored in a memory, for example, by a manufacturer based on empirical data.

Specifically, in the first variation, as illustrated in FIG. 7, first, the reader/writer 55 determines whether the new developing device 13 is set in the image forming apparatus 1 (step S1). As a result, when the reader/writer 55 determines that the new developing device 13 is set in the image forming apparatus 1, the developing device 13 is driven (preferably in the reverse rotation) for a short time that does not cause the developing device 13 to lock, and the torque detector 52 detects the torque, and the controller 50 determines whether the torque exceeds the predetermined threshold value A (step S10).

As a result, when the controller 50 determines that the torque exceeds the predetermined threshold value A, the controller 50 performs the warm-up operation on the assumption that the developer G in the developing device 13 is extremely leant to one side (steps S2 to S4). On the other hand, when the controller 50 determines that the torque does not exceed the predetermined threshold value A, on assumption that the developer G in the developing device 13 is hardly leant to one side (i.e., leveled evenly), the controller 50 does not performs the warm-up operation, and the process is ended as is.

In such a control according to the first variation, similar effects to those of the above-described embodiments are also attained. In particular, in the first variation, since the warm-up operation is performed only when the controller 50 determines that the developer G in the developing device 13 is extremely leant to one side. Thus, the warm-up operation does not make a user wait when not needed.

Figure 8:
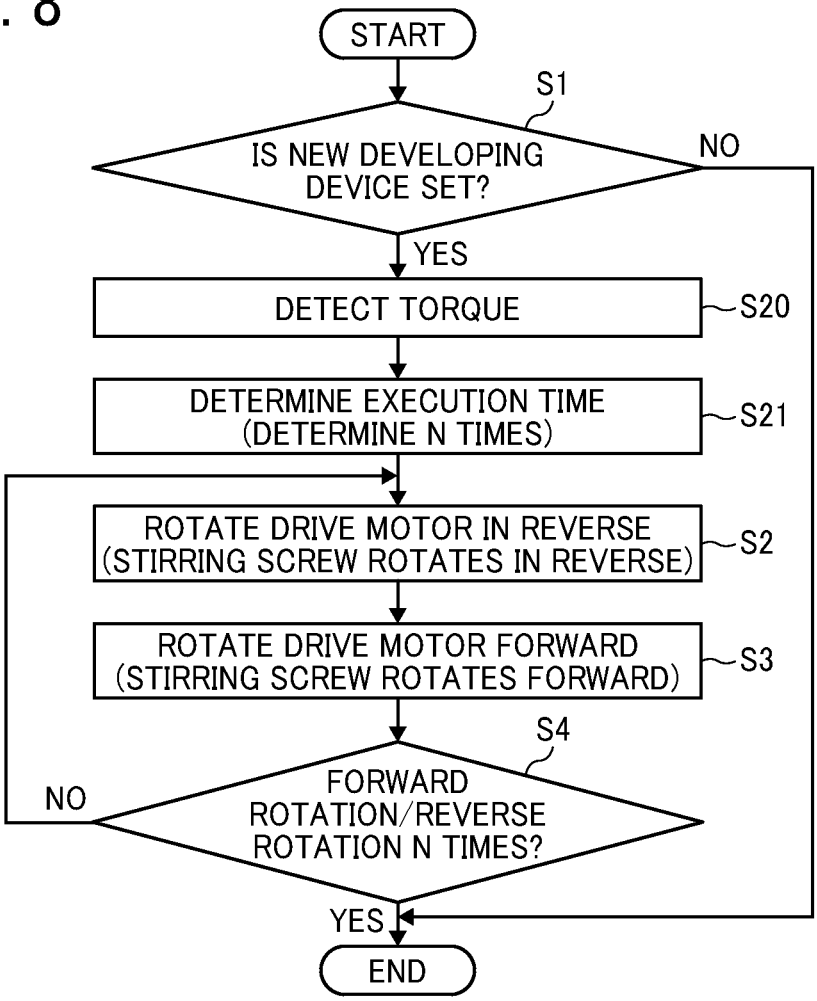
FIG. 8 is a flowchart of a control process executed when a new developing device is installed in the image forming apparatus according to a second variation.

FIG. 8 is a flowchart of a control process executed when a new developing device 13 is set in the image forming apparatus 1 according to a second variation, corresponding to FIG. 7 in the first variation.

Similarly to the first variation, the image forming apparatus 1 according to the second variation also includes the torque detector 52 that detects the torque applied when the first and second stirring screws 13*b*1 and 13*b*2 rotate.

In the second variation, when the torque detected by the torque detector 52 is large, an execution time of the warm-up operation is longer than when the torque detected by the torque detector 52 is small.

Specifically, in the second variation, as illustrated in FIG. 8, first, the reader/writer 55 determines whether the new developing device 13 is set in the image forming apparatus 1 (step S1). As a result, when the reader/writer 55 determines that the new developing device 13 is set in the image forming apparatus 1, the developing device 13 is driven (preferably in the reverse rotation) for a short time that does not cause the developing device 13 to lock, and the torque detector 52 detects the torque (step S20). Then, the controller 50 determines the execution time of the warm-up operation (i.e., N times in step S4) based on the detected result (step S21). Specifically, when the torque detected by the torque detector 52 is large, the controller 50 sets the number of times to repeat the reverse rotation and the forward rotation cycles of the drive motor 51 (i.e., N times) during the warm-up operation to large number.

Then, the controller 50 performs the warm-up operation for the execution time (N times) determined in step S21 (steps S2 to S4).

In such a control according to the second variation, similar effects to those of the above-described embodiments are also attained. In particular, in the second variation, since the execution time of the warm-up operation is varied according to the magnitude of the uneven distribution of the developer G in the developing device 13, the controller 50 performs the warm-up operation for an appropriate time. As a result, the problem that the warm-up operation makes a user wait unnecessarily is prevented.

Figure 9:
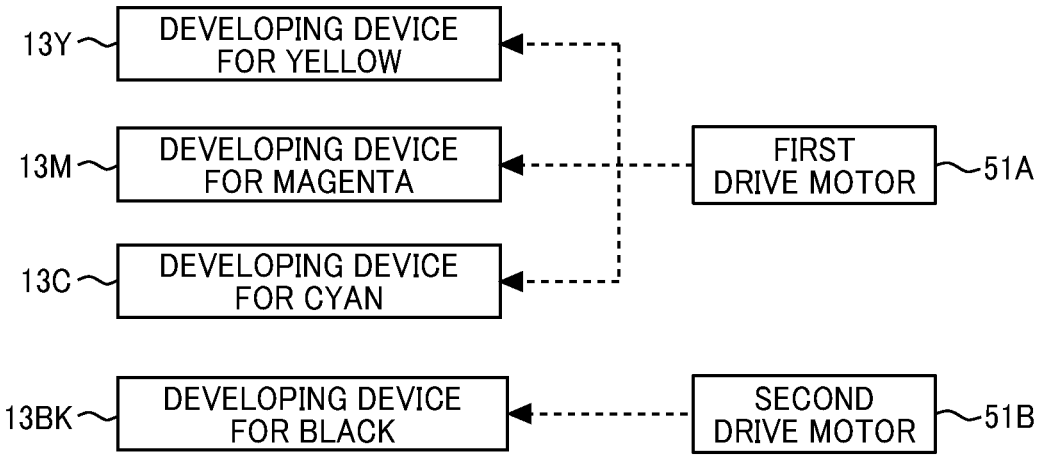
FIG. 9 is a schematic view illustrating a relationship between a plurality of developing devices and a plurality of drivers according to a third variation.

FIG. 9 is a schematic diagram illustrating a relationship between a plurality of developing devices 13Y, 13M, 13C, and 13 BK and a plurality of drive motors (drivers) 51A and 51B according to a third variation.

As illustrated in FIG. 9, the image forming apparatus 1 according to the third variation includes the plurality of developing devices (i.e., the developing devices 13Y, 13M, 13C, and 13 BK), and further includes a first drive motor 51A as a first driver configured to drive the first and second stirring screws (stirring rotators) 13*b*1 and 13*b*2 of some of the plurality of developing devices (i.e., the developing devices 13Y, 13M, and 13C), respectively. The image forming apparatus 1 further include a second drive motor 51B as a second driver configured to drive the first and second stirring screws 13*b*1 and 13*b*2 of the other of the plurality of developing devices (i.e., the developing device 13BK in the third variation). The number of the other of the plurality of developing devices is less than the number of the some of the plurality of developing devices (in the third variation, 1 is less than 3).

Specifically, similarly to the above-described embodiments, the developing devices 13Y, 13M, 13C, and 13BK for four colors (i.e., yellow, magenta, cyan, and black) are removably installed in the image forming apparatus 1 according to the third variation. The first drive motor 51A as one driving source drives the some of the plurality of developing devices (i.e., the three developing devices 13Y, 13M, and 13C for colors) in the forward rotation and the reverse rotation via a plurality of gear trains. On the other hand, the second drive motor 51B different from the first drive motor 51A drives the other of the plurality of developing devices (i.e., the one developing device 13BK for black) in the forward rotation and the reverse rotation via a gear train.

In the third variation, an execution time (N times) of the warm-up operation performed in the three developing devices 13Y, 13M, and 13C by the first drive motor (the first driver) 51A is longer than an execution time (N times) of the warm-up operation performed in the one developing device 13BK by the second drive motor (the second driver) 51B.

The load applied to the first drive motor 51A that drives the three developing devices 13Y, 13M, and 13C is originally higher than the load applied to the second drive motor 51B that drives the one developing device 13BK. For this reason, if the developer G is extremely leant to one side in the developing devices 13Y, 13M, and 13C, the first drive motor 51A is likely to lock. On the other hand, in the third variation, since the execution time of the warm-up operation of the three developing devices 13Y, 13M, and 13C is set to be long, such a problem is less likely to occur.

In the third variation, similar effects to those of the above-described embodiments are also attained.

As described above, in the image forming apparatus 1 according to the above-described embodiments, when the reader/writer (the device detector) 55 detects that the developing device 13 being in a predetermined condition is set in the image forming apparatus 1, the controller 50 as control circuitry executes the warm-up operation in which the drive motor 51 as a driver drives the first and second stirring screws 13*b*1 and 13*b*2 as stirring rotators alternately in the reverse rotation and the forward rotation.

As a result, in the developing device 13 set in the image forming apparatus 1, the drive motor 51 is less likely to lock due to the increase in the load for driving the first and second stirring screws 13*b*1 and 13*b*2.

Therefore, according to the present disclosure, an image forming apparatus can be provided to prevent a driver from locking due to an excessive load to rotate a stirring rotator in a developing device installed in the image forming apparatus.

It is to be noted that, in the above-described embodiments, the second stirring screw 13*b*2 serving as the collection screw is disposed above the first stirring screw 13*b*1 serving as the supply screw, and the doctor blade 13*c* is disposed below the developing roller 13*a* in the two-component type developing device 13. The present disclosure can be applied to a developing device employing two-component development method in which a second stirring screw serving as a collection screw is disposed below a first stirring screw serving as a supply screw and a doctor blade is disposed above a developing roller, or another developing device employing two-component development method in which a plurality of conveyors is horizontally arranged in parallel. Further, the present disclosure can be applied to yet another developing device employing one-component development method using only toner without carrier as a developer. However, the configuration of the developing device to which the present disclosure is applied is not limited to the above-described configurations.

In the above-described embodiments, the present disclosure is applied to the developing device 13 in which the developing roller 13*a* is disposed across a gap from the photoconductor drum 11 as the image bearer. Alternatively, the present disclosure can be applied to a developing device employing contact type one-component development method in which a developing roller contacts an image bearer.

In such configurations, effects similar to those described above are also attained.

Further, the present disclosure is applied to the image forming apparatus 1 in which the developing device 13 is separately installed. Alternatively, the present disclosure is not limited to the above described configuration and can be applied to an image forming apparatus in which a developing device constitutes a process cartridge together with other components. In this case, workability of maintenance of the image forming unit can be improved.

It is to be noted that the term "process cartridge" used in the present disclosure means a unit including an image bearer and at least one of a charger to charge the image bearer, a developing device to develop latent images on the image bearer, and a cleaner to clean the image bearer united together and designed to be removably installed together in the image forming apparatus.

Further, in the above-described embodiments, when the warm-up operation is performed, the first and second stirring screws (stirring rotators) 13*b*1 and 13*b*2 are rotated in the forward direction or the reverse direction along with the developing roller 13*a*. However, the developing roller 13*a* may not be rotated, and only the first and second stirring screws (stirring rotators) 13*b*1 and 13*b*2 may be rotated in the forward direction or the reverse direction. In that case, a drive system for driving the developing roller 13*a* and a drive system for driving the first and second stirring screws 13*b*1 and 13*b*2 are provided independently of each other.

In such configurations, effects similar to those described above are also attained.

It is therefore to be understood that within the scope of the present disclosure, the present disclosure may be practiced otherwise than as specifically described herein. The above-described embodiments are illustrative and do not limit the present disclosure. Thus, numerous additional modifications and variations are possible in light of the above teachings. The number, position, and shape of the components described above are not limited to those embodiments described above. Desirable number, position, and shape can be determined to perform the present disclosure.

Any one of the above-described operations may be performed in various other ways, for example, in an order different from the one described above.

Each of the functions of the described embodiments may be implemented by one or more processing circuits or control circuitry. Processing circuitry includes a programmed processor, as a processor includes control circuitry. A processing circuit also includes devices such as an application specific integrated circuit (ASIC), DSP (digital signal processor), FPGA (field programmable gate array) and conventional circuit components arranged to perform the recited functions.

What is claimed is:

1. An image forming apparatus comprising:

a developing device including a first stirring rotator and a second stirring rotator each to stir a developer in the developing device, the first stirring rotator being disposed in the developing device such that when the developing device is installed within the image forming apparatus, the first stirring rotator is lower with respect to a direction of gravity than the second rotator, the first stirring rotator disposed in a first transport path, and the second stirring rotator being disposed in a second transport path, the first transport path and the second transport path being connected by a communication opening through which the developer is raised from the first stirring rotator to the second stirring rotator;

a driver configured to drive the first stirring rotator and the second stirring rotator in forward and reverse rotation;

a device detector configured to detect whether the developing device is installed in the image forming apparatus; and control circuitry configured to execute a warm-up operation in which the driver drives the first stirring rotator and the second stirring rotator alternately in the reverse rotation and the forward rotation in response to a detection of setting of the developing device in the image forming apparatus by the device detector and a detection of a predetermined condition, wherein the driver is configured to drive the first stirring rotator and the second stirring rotator in an order of the reverse rotation and the forward rotation alternately in the warm-up operation, wherein the forward rotation is a direction used to accumulate the developer for use by the developing device, and the reverse rotation transports the developer in a direction opposite to the direction used to accumulate, wherein a cycle includes driving the first stirring rotator and the second stirring rotator first in the reverse direction followed by a forward rotation of the first stirring rotator and the second stirring rotator, wherein the control circuitry is configured to cause the driver to drive the first stirring rotator and the second stirring rotator in the reverse rotation longer than in the forward rotation for a plurality of the cycles consecutively during the warm-up operation.

2. The image forming apparatus according to claim 1, wherein the predetermined condition is that the developing device is unused and set in the image forming apparatus for the first time.

3. The image forming apparatus according to claim 1, further comprising a torque detector configured to detect torque applied when the first stirring rotator and the second stirring rotator rotate, wherein the predetermined condition is that the torque detected by the torque detector exceeds a predetermined threshold value.

4. The image forming apparatus according to claim 1, further comprising a torque detector configured to detect torque applied when the first stirring rotator and the second stirring rotator rotates, wherein the control circuitry is configured to increase a duration of the warm-up operation as torque detected by the torque detector increases.

5. The image forming apparatus according to claim 1, further comprising an image bearer, wherein the developing device includes a developing roller opposed to the image bearer or in contact with the image bearer, and wherein the driver is configured to drive the developing roller along with the first stirring rotator and the second stirring rotator.

6. The image forming apparatus according to claim 1, wherein:

the first stirring rotator and the second stirring rotator are coupled to the driver such that the first stirring rotator rotates in a direction opposite to a direction of rotation of the second stirring rotator.

7. The image forming apparatus according to claim 1, further comprising:

a first gear on an end of the first stirring rotator; and a second gear on an end of the second stirring rotator, the first gear and the second gear meshing such that the first gear rotates in a direction which is opposite to a direction that the first gear rotates.

8. An image forming apparatus comprising:

a developing device including at least one stirring rotator configured to stir a developer in the developing device;

a driver configured to drive the at least one stirring rotator in forward and reverse rotation;

a device detector configured to detect whether the developing device is set in the image forming apparatus;

control circuitry configured to execute a warm-up operation in which the driver drives the at least one stirring rotator alternately in the reverse rotation and the forward rotation in response to a detection of setting of the developing device in the image forming apparatus by the device detector and a detection of a predetermined condition;

a plurality of developing devices including the developing device; and a first driver and a second driver serving as the driver, wherein the first driver is configured to drive the at least one stirring rotator of some of the plurality of developing devices, and the second driver is configured to drive the at least one stirring rotator of other of the plurality of developing devices, wherein the number of the other of the plurality of developing devices is less than the number of the some of the plurality of developing devices, and wherein an execution time of the warm-up operation with the first driver is longer than an execution time of the warm-up operation with the second driver.

* * * * *